United States Patent [19]

Holland et al.

[11] Patent Number: 4,577,780

[45] Date of Patent: Mar. 25, 1986

[54] ARTICLE-DISPENSING ASSEMBLY FOR A VENDING MACHINE

[75] Inventors: Charlie R. Holland, St. Louis; Michael J. DelPercio, Fenton, both of Mo.

[73] Assignee: Coin Acceptors, Inc., St. Louis, Mo.

[21] Appl. No.: 451,035

[22] Filed: Dec. 20, 1982

[51] Int. Cl.[4] ..... G07F 11/00

[52] U.S. Cl. ..... 221/125; 221/194; 221/251; 74/527

[58] Field of Search ..... 221/191, 194, 245, 251, 221/255, 256, 263, 266, 289, 92, 123, 124, 125, 129; 74/527

[56] References Cited

U.S. PATENT DOCUMENTS

| | | | |
|---|---|---|---|
| Re. 21,451 | 5/1940 | Woodward et al. | 221/125 X |
| 772,226 | 10/1904 | Disbrow | 221/245 |
| 2,150,469 | 3/1939 | Tozer et al. | 221/194 X |
| 2,513,595 | 7/1950 | Stewart | 221/125 |
| 2,521,458 | 9/1950 | Huheey et al. | 221/125 |
| 3,190,493 | 6/1965 | Johnson et al. | 221/125 |

*Primary Examiner*—Joseph J. Rolla

*Attorney, Agent, or Firm*—Cohn, Powell & Hind

[57] ABSTRACT

An article-dispensing assembly including a door movably mounted on a plate for opening and closing an opening provided in the plate, the door including a shelf extending inwardly of the opening and providing a bin for holding an article to be dispensed. A control mechanism is movable to a first position to allow transfer of an article from a feed mechanism to the bin, and movable to a second position to block transfer of an article from the feed unit to the bin. An operating unit interconnects the control unit and door to allow loading of the bin when the door is in its closed position and to preclude loading of the bin when the door is moved from the closed position. A slide bar is slidably mounted and extends transversely of the bin. An interlock unit is movably mounted at one side of the opening to a first position that blocks sliding movement of the slide bar, and to a second position allowing sliding movement of the slide bar to an extended position. A coin-actuating unit connected to the interlock unit moves the interlock unit from its first position to its second position. A slide bar actuating unit operatively interconnects the door and the slide bar to preclude movement of the door from its closed position when the interlock unit is in its first position, and operatively engages the slide bar to move the slide bar to the extended position to allow movement of the door from its closed position to its open position when the interlock is in its second position. The interlock unit is engageable with the slide bar to move the slide bar from the extended position back to its initial position.

27 Claims, 16 Drawing Figures

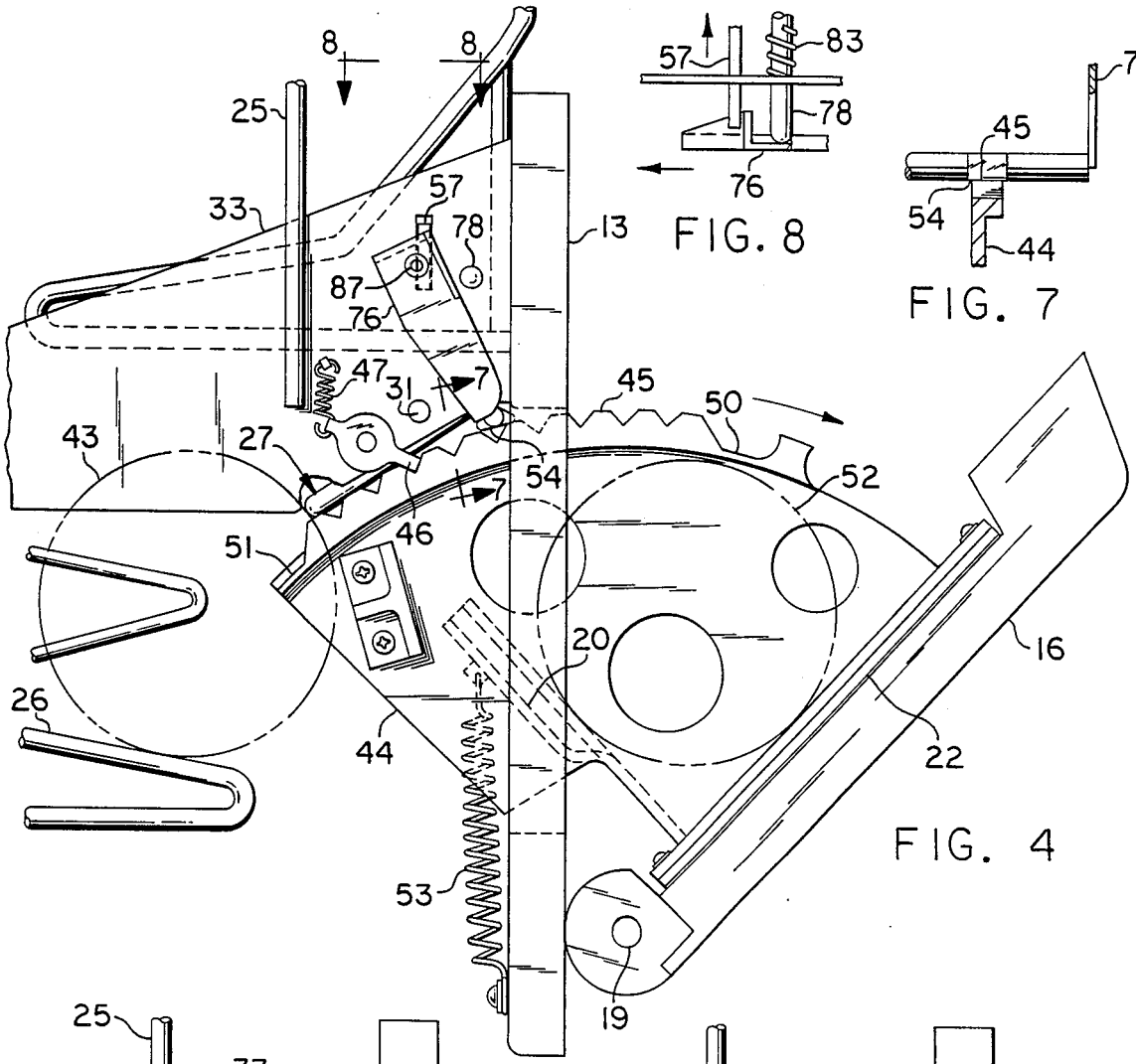
FIG. 4
FIG. 8
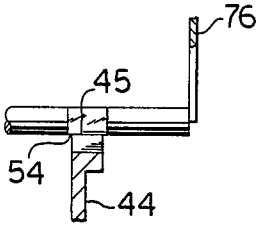
FIG. 7
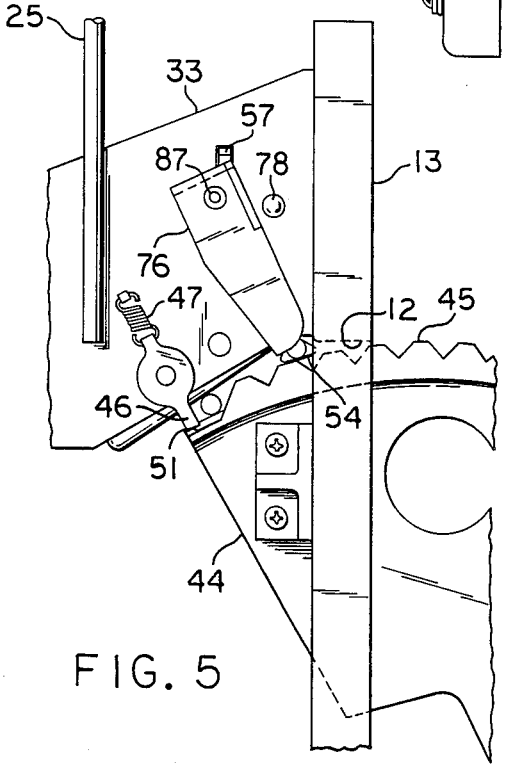
FIG. 5
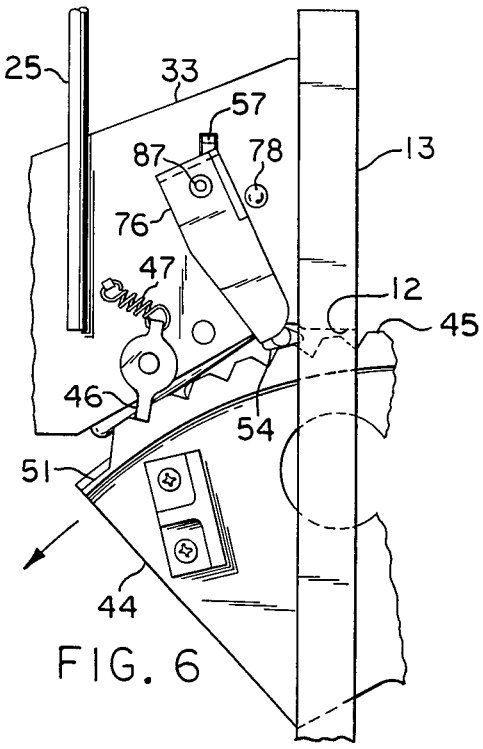
FIG. 6

ARTICLE-DISPENSING ASSEMBLY FOR A VENDING MACHINE

BACKGROUND OF THE INVENTION

This invention relates generally to an article-dispensing assembly for a vending machine, and more particularly to the vending of articles such as cans by the opening and closing of doors associated with a particular article to be dispensed.

The heretofore conventional vending machines for dispensing a plurality of items including cans are large free-standing units utilizing complicated dispensing mechanisms. These machines drop one article from a plurality of stacks into a single open dispensing compartment.

SUMMARY OF THE INVENTION

The present article-dispensing assembly is particularly adapted for a relatively small machine that can stand on a counter or can be wall-mounted. This vending machine is adapted to deliver one article from each stack of articles by the use of a delivery door associated with each particular article to be dispensed.

In the present article-dispensing assembly, a door is movably mounted on a plate and is adapted to open and close an opening provided in the plate. The door includes a shelf extending inwardly of the opening that provides a bin for holding an article to be dispensed. A control means is movable to a first position to allow transfer of an article from a feed means to the bin, and movable to a second position to block transfer of an article from the feed means to the bin. Selectively interconnecting the control means and the door is an operating means to allow loading of the bin when the door is in its closed position, and to preclude loading of the bin when the door is moved from its closed position. A slide bar is slidably mounted and extends transversely of the bin. Movably mounted at one side of the opening is an interlock means that is movable to a first position that blocks sliding movement of the slide bar, and to a second position allowing sliding movement of the slide bar to an extended position. A coin-actuating means is connected to the interlock means, and selectively moves the interlock means from its first position to its second position. Operatively interconnecting the door and the slide bar is a slide bar actuating means that precludes movement of the door from its closed position when the interlock means is in its first position, the slide bar actuating means operatively engaging the slide bar to move the slide bar to the extended position to allow movement of the door from its closed position to its open position when the interlock means is in its second position.

In one aspect of the article-dispensing assembly, the interlock means is selectively engageable with the slide bar to move the slide bar from the extended position to its initial position when the door is moved from its open position to its closed position.

In another aspect of the article-dispensing assembly, a catch means engages and holds the interlock means in the second position, and the slide bar engages and releases the catch when the slide bar is moved to its extended position with the interlock means and the slide bar in overlapping relation.

In still another aspect of the article-dispensing assembly, the interlock means includes a resilient means tending to urge the interlock means against the slide bar to retract the slide bar from its extended position to its initial position when the door is moved to its closed position.

In one aspect of the article-dispensing assembly, the catch means engages and holds the interlock means in the second position, and the slide bar engages and releases the catch when the slide bar is moved to its extended position with a cam surface of the interlock means and a cam surface of the slide bar in overlapping relation.

In another aspect of the article-dispensing assembly, the control means includes a pivotally mounted cradle, the cradle having a rod extending transversely between the feed means and the door bin. The operating means is operatively connected to the cradle and tends to hold the transverse rod in a first position to allow transfer of an article from the feed means to the bin. A resilient means is connected to the cradle, and tends to urge the transverse rod toward a second position to preclude transfer of an article from the feed means to the bin.

In another aspect of the article-dispensing assembly, the operating means includes a sidewall on the door having a peripheral ledge and a peripheral recess leading to the ledge. The control means includes a lateral projection selectively engageable with the seating on the peripheral ledge to hold the control means in the first position to allow transfer of an article from the feed means when the door is closed, the lateral projection unseating from the ledge and moving into the peripheral recess to move the control means in the second position to preclude transfer of an article from the feed means when the door is moved from the closed position.

In still another aspect of the article-dispensing assembly, a resilient means is connected to the cradle and tends to maintain the lateral projection seated on the ledge, and tends to urge the rod toward its second position when the projection is unseated from the ledge when the door is moved from the closed position.

One aspect of the article-dispensing assembly is that the operating means interconnecting the control means and the door preclude manual actuation of the control means to the first position when the door is moved from the closed position.

Another aspect of the article-dispensing assembly is provided in that the operating means includes a sidewall on the door having a peripheral margin, and a pad is provided on the control means that selectively engages the peripheral margin to preclude movement of the control means from the second position when the door is moved from the closed position.

Still another aspect of the article-dispensing assembly is provided in that the operating means interconnecting the control means and the door includes a sidewall on the door having a peripheral margin, the peripheral margin being provided with ratchet teeth, and a pivotally mounted, double-acting pawl operatively engaging the teeth for assuring door movement to either a fully opened or fully closed position before reversal to the other position.

One aspect of the article-dispensing assembly is provided by a plurality of door openings, and a plurality of doors mounted on the plate adapted to open and close the door openings, each door having a bin. A plurality of feed means are provided for feeding articles to the door bins. There is a control means for each door, and the operating means selectively interconnects the control means for each door and the associated door. There are a plurality of slide bars slidably mounted in longitudinal alignment, one of the slide bars being slidably mounted and extending transversely of each door bin. The interlock means is movably mounted at one side of one end door opening, and is movable to a first position blocking sliding movement of the slide bar of the one end door opening, and to a second position on allowing sliding movement of the last said slide bar to an extended position. The slide bar actuating means operatively interconnects each door and the slide bar associated with said door to preclude movement of any door from its closed position when the interlock means is in its first position. The slide bar actuating means operatively engages the slide bar associated with one selected door to move adjacent aligned slide bars located at one side so that the slide bar of the said one end door opening is moved to the extended position to allow movement of the said one selected door from its closed position to its open position when the interlock means is in its second position.

Another aspect of the article-dispensing assembly is provided in that the slide bar actuating means is operatively connected to said one selected door to block the adjacent aligned slide bars located at the said other side when the selected door is opened to preclude opening of any door located at said other side.

Still another aspect of the article-dispensing assembly is provided in that the slide bars associated with the doors adjacent said one side of said selected door blocks the slide bar actuating means associated with each said adjacent door when the selected door is opened to preclude opening of any doors located at said one side.

One aspect of the article-dispensing assembly is provided in that the interlock means is selectively engageable with the slide bar of the one end door opening to move the last said slide bar from the extended position and move the aligned interengaging slide bars back to initial positions when the said selected door is moved from its open position to its closed position.

BRIEF DESCRIPTION OF THE DRAWINGS

FIG. 4 is a side elevational view similar to FIG. 2, illustrating the door in a partly opened position;

FIG. 5 is a fragmentary view of the door assembly of FIG. 4, showing the door in a fully opened position;

FIG. 6 is a fragmentary view of the door assembly of FIG. 4, illustrating the door being moved toward a closed position;

FIG. 7 is a fragmentary, cross-sectional view taken on line 7—7 of FIG. 4;

FIG. 8 is a fragmentary view taken on line 8—8 of FIG. 4;

FIG. 15 is a fragmentary view taken on line 15—15 of FIG. 12, and.

DESCRIPTION OF THE PREFERRED EMBODIMENT

Figure 1:
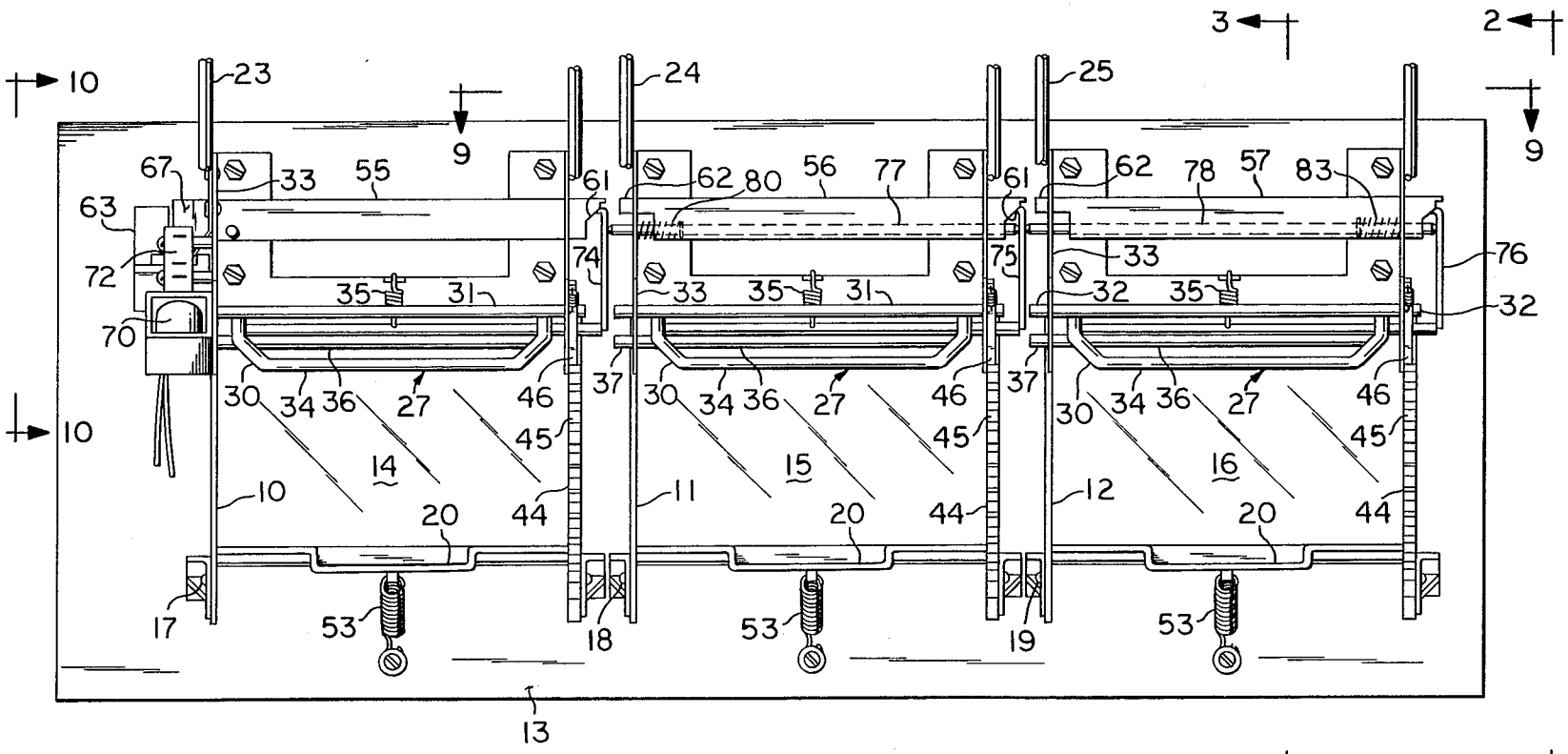
FIG. 1 is a rear elevational view of the article-dispensing assembly.

Referring now by characters of reference to the drawings, and first to FIG. 1, it will be understood that the article-dispensing assembly for the vending machine includes a plurality, a total of three in the embodiment disclosed of door openings 10, 11 and 12 formed in a front vending machine plate 13, the openings 10–12 being disposed in spaced horizontal alignment. A plurality of doors 14, 15 and 16 are provided, one door for each of the openings 10–12 respectively. Each of these doors 14–16 is movably or hingedly mounted to the front plate 13 below its associated door opening 10–12 respectively by a hinge connection 17, 18 and 19 respectively. Each of the doors 14–16 is movable selectively to a first closed position to close its associated opening 10–12 respectively, and to a second open position to open its associated opening 10–12 respectively.

Each of the doors 14–16 includes a shelf 20 extending inwardly of its associated opening 10–12 respectively, the shelf 20 cooperating with the rear face of the door 14–16 to provide a bin for holding an article, such as a cylindrical can, to be dispensed. As is best seen in FIG. 3, each door includes a window opening 21 covered by a transparent panel 22 to enable one to view the article to be dispensed and being held in the bin provided by the door 16.

A feed means is provided for feeding articles to each of the bins. The feed means includes a conventional serpentine rack 23, 24 and 25 associated with each of the door openings 10–12 respectively, and extending upwardly therefrom. Each of the racks 23–25 is adapted to retain a plurality of articles, and to feed under gravity such articles in sequence one by one into the bin of the associated door 14–16 respectively. As is shown in FIG. 3, the bottom of each rack 23–25 includes an inclined ledge 26 on which the lowermost article in the rack seats and is guided into the bin of the associated door when the door is fully closed as will be later explained.

Figure 3:
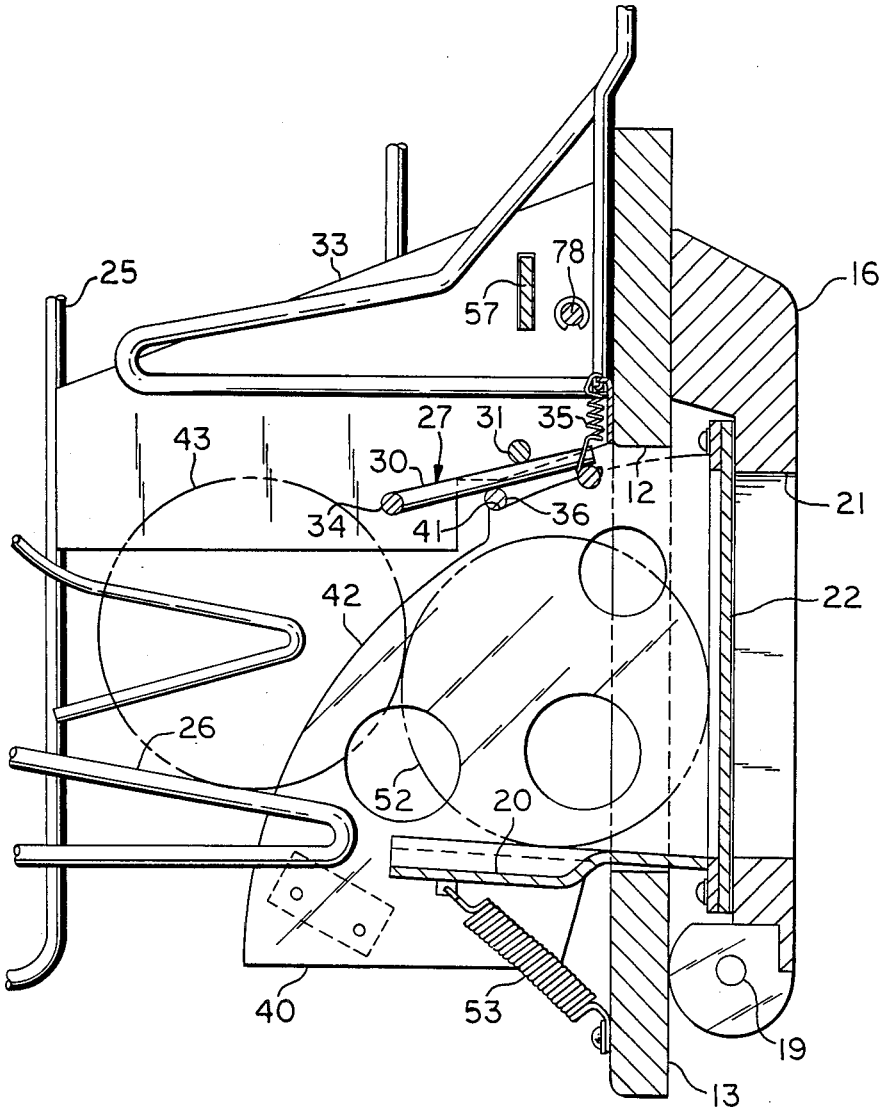
FIG. 3 is a fragmentary view, partly in cross-section, of the opposite side of the door assembly of FIG. 2 as taken on line 3—3 of FIG. 1.

A control means generally indicated by 27 is movable to a first position as illustrated in FIG. 3 when the door 16 is fully closed to allow transfer of an article from the rack ledge 26 to the bin of the door 16, and is movable to a second position as illustrated in FIG. 4 when the door 16 is moved from its first closed position in a direction toward its second open position to block transfer of an article seated on the rack ledge 26.

More particularly, the control means 27 includes a cradle 30 having a transverse rod 31, and having sides 32 pivoted on a pivot axis in opposed, laterally spaced brackets 33 extending rearwardly from and attached to the rear face of the plate 13. The cradle 30 further includes another transverse rod 34 at one side of the pivot axis, the rod 34 extending between the feed means 25 and the door bin, and adapted to engage and hold the article seated on the rack ledge 26 and preclude transfer of the article to the door bin when the door 16 is fully closed. Connected to the cradle 30 is a tension spring 35, constituting a resilient means, that tends to pivot the cradle 30 and urge the transverse rod 34 toward its second position into the path of the article to preclude transfer from the feed 25.

The control means 27 further includes another transverse rod 36 having a lateral projection 37 at one side, the purpose of which will be explained upon later detailed description of parts.

An operating means selectively interconnects the control means and each door 14–16 to allow loading of the door bin when the door 14–16 is in its first closed position, and to preclude loading of the bin when the door 14–16 is moved from its first closed position. This operating means is operatively connected to the cradle 27 associated with each door 14–16, and tends to hold the transverse rod 34 in its first position out of the path of the articles retained on the rack ledge 26 to allow transfer from the rack ledge 26.

More particularly, the operating means includes a sidewall 40 on each of the doors 14–16 extending inwardly of the associated opening 10–12 respectively, and cooperating with the associated door and door shelf 20 to form the door bin. The sidewall 40 on the door 16, for example, includes a peripheral ledge 41, and an adjacent peripheral curvilinear recess 42 leading to the ledge 41. The lateral portion 37 of the cradle rod 36 is selectively engageable with and seats on the peripheral ledge 41, as is illustrated in FIG. 3, to hold the cradle 30 with its transverse rod 34 in the first position out of the path of the article 43 seated on the rack ledge 26 to allow transfer of the article 43 to the associated door bin when the door 16 is closed. When the door 16 is moved from the closed position, the lateral projection 37 of transverse rod 36 is unseated from the peripheral ledge 41, and moves into and along the peripheral recess 42, thereby allowing pivotal movement of the cradle 30 so that the transverse rod 34 is located in its second position in the path of the article 43 to preclude transfer of the article 43 from the rack ledge 26.

In addition, the operating means interconnecting the control means and each door 14–16 includes another opposed sidewall 44 that also cooperates with the sidewall 40 and the shelf 20 of the associated door to define the door bin. Each sidewall 44 is provided with a peripheral curvilinear margin having a plurality of ratchet teeth 45. Pivotally mounted on the adjacent bracket 33 is a double-acting pawl 46 operatively engaging the ratchet teeth 45 for assuring door movement to either a fully open or fully closed position before reversal of the door to the other position. The pawl 46 is operatively connected to the bracket 33 by a spring 47, constituting a resilient means, the spring 47 tending to urge the pawl 46 into the neutral position shown in FIG. 2.

Figure 2:
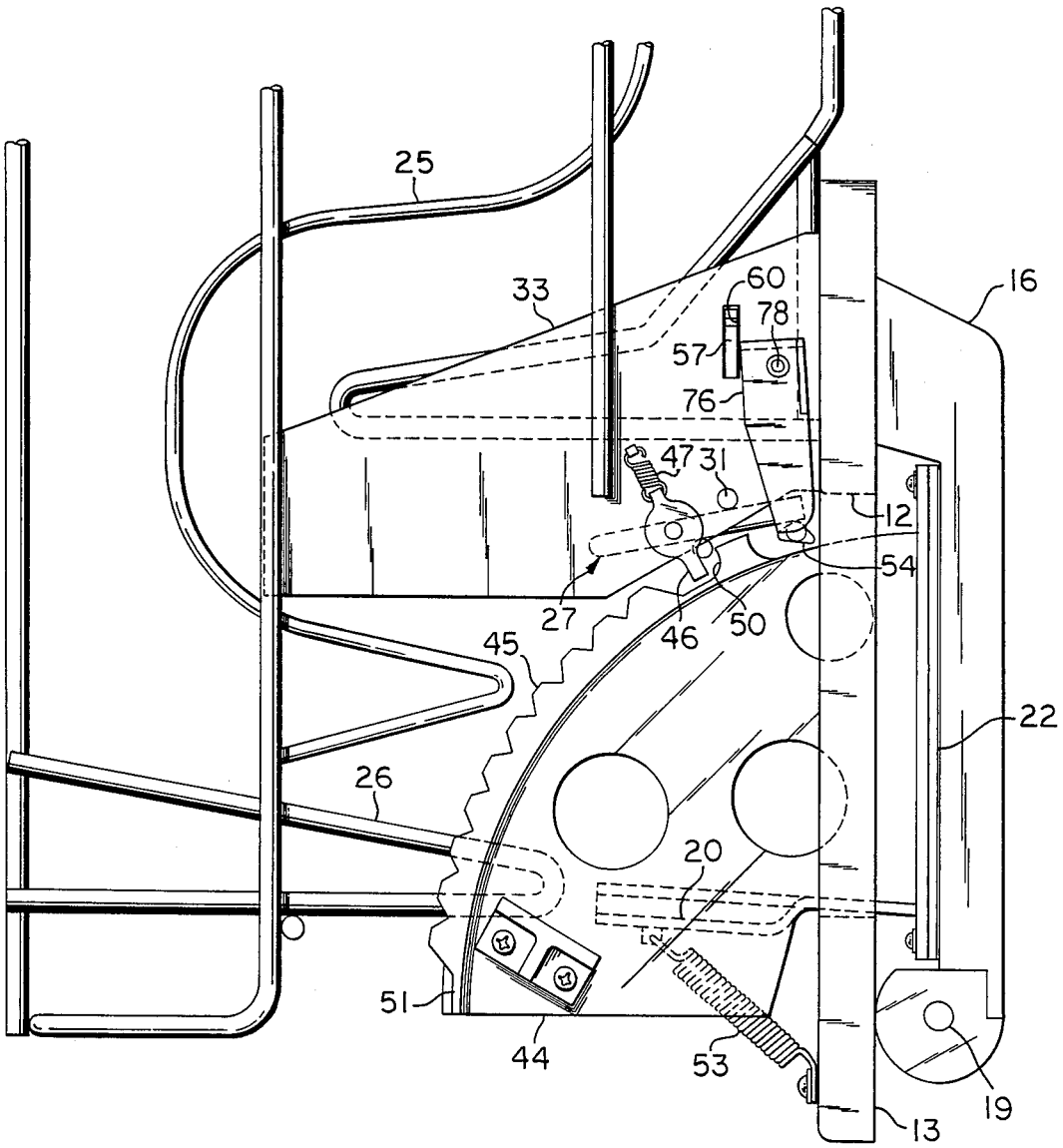
FIG. 2 is a fragmentary side elevational view of one side of a door assembly taken on line 2—2 of FIG. 1.

When each door 14–16 is located in its first closed position, as for example door 16 in FIG. 2, the pawl 46 is located in its neutral position in a dwell 50 provided in the peripheral margin. As the door 16 is moved from its first closed position as shown in FIG. 4, the pawl 46 is pivotally moved against spring loading into engagement with one side of the ratchet teeth 45 to preclude movement of the door 16 in a direction toward its first closed position.

Again, when the door 16 is in its fully opened position as illustrated in FIG. 5, the pawl 46 is again disposed in its neutral position and located in another dwell 51 formed in the peripheral margin.

The weight of the article 52 retained in the bin of the opened door 16 tends to hold the door 16 in its open position against the loading of the tension spring 53. When the user removes the dispensed article 52, the spring 53 will automatically move the door 16 from its second open position toward and to its first closed position. As the door 16 moves toward the closed position, the pawl 46 is pivoted in the opposite direction against the loading of its spring 47 to engage the opposite side of ratchet teeth 45 as disclosed in FIG. 6, thereby precluding the door 16 from being reversed and moved to its open position until the door 16 has been fully closed.

The operating means interconnecting the control means and each door 14–16 precludes manual actuation of the control means to the first position that would permit transfer of the article 43 in the rack into the door bin when the door is moved from its closed position. For example, a pad 54 is carried by the cradle 30 and moves over the top of the ratchet teeth 45 in slightly spaced relation as the door 16 is moved from its closed position to its open position. If the user attempts to reach in and tilt the cradle 30 to the position shown in FIG. 4 to the position shown in FIG. 3 in an attempt to deliver another article into the door bin, the pad 54 engages the top of the ratchet teeth 45 and precludes such cradle movement, and thereby precludes unauthorized and unwanted transfer of the article 43 seated on the rack ledge 26 into the door bin.

A plurality of slide bars 55, 56 and 57 are slidably mounted in longitudinal alignment, each of the slide bars 55–57 is received in compatible slots 60 formed in the spaced associated brackets 33, and is extended transversely of the associated door bin. Each slide bar 55–57 includes a first cam surface 61 at one end projecting laterally from one of the brackets 33. The opposite end 62 of slide bars 56 and 57 extending laterally from the opposed associated brackets 33, is adapted to engage the adjacent first end of the next adjacent slide bar.

Figure 10:
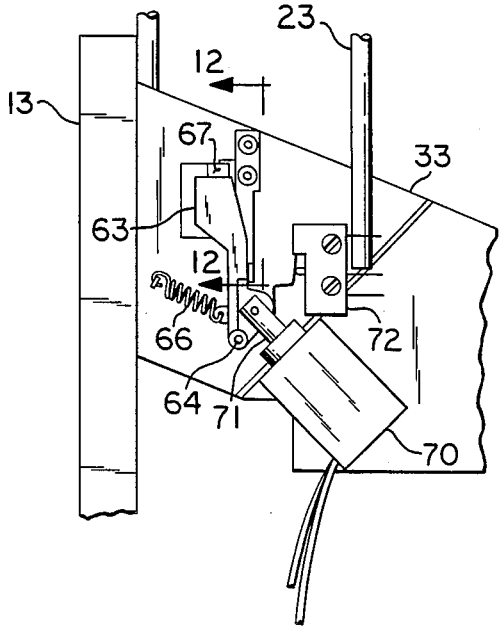
FIG. 10 is a fragmentary side elevational view of the coin-actuating means taken on line 10—10 of FIG. 1.
Figure 11:
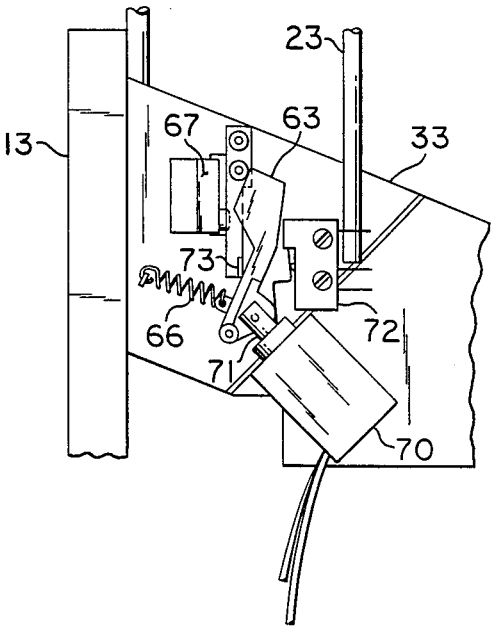
FIG. 11 is a fragmentary side elevational view of the coin-actuating means of FIG. 10, illustrating actuation of the solenoid.
Figure 15:
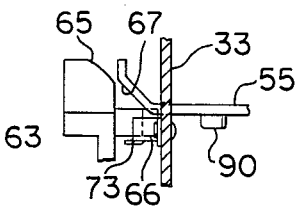

Movably mounted on the bracket 33 at one side of the one end door opening 10, is an interlock means that in a first position blocks sliding movement of the slide bars 55–57, the interlock means being movable to a second position to allow sliding movement of the end slide bar 55 to an extended position upon movement of any one door 14–16 to its open position. As is best seen in FIGS. 10–11, the interlock means includes an interlock arm 63 that is pivotally mounted to bracket 33 by a pivot pin 64. The interlock arm 63 includes a cam surface 65 that is selectively engageable with the cam surfaces 67 of the slide bar 55, and includes a projection 66. A tension spring 68, constituting a resilient means, tends to urge the interlock arm 63 to its upright first position as shown in FIG. 10.

A solenoid 70, constituting a coin-actuating means, includes an armature 71 that is pivotally mounted to the interlock arm 63, the solenoid 70 when actuated selectively moving the interlock arm 63 from its first position shown in FIG. 10 to its second position shown in FIG. 11 against the loading of the spring 68. When the interlock arm 63 is moved to its second position, it actuates the electrical switch 72.

Figure 13:
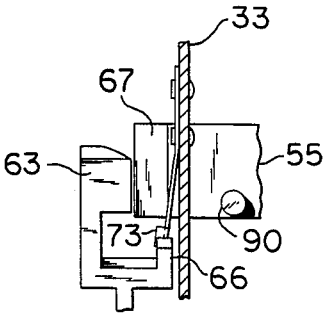
FIG. 13 is a fragmentary cross-sectional view similar to FIG. 12, illustrating the interengagement of the catch and interlock member.
Figure 14:
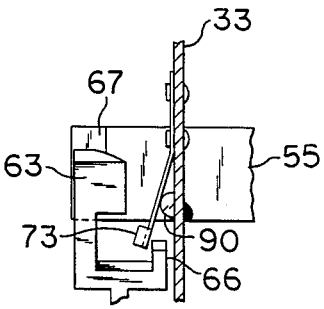
FIG. 14 is a fragmentary view similar to FIGS. 12–13, illustrating the release of the catch and the interlock member by the side bar.
Figure 16:
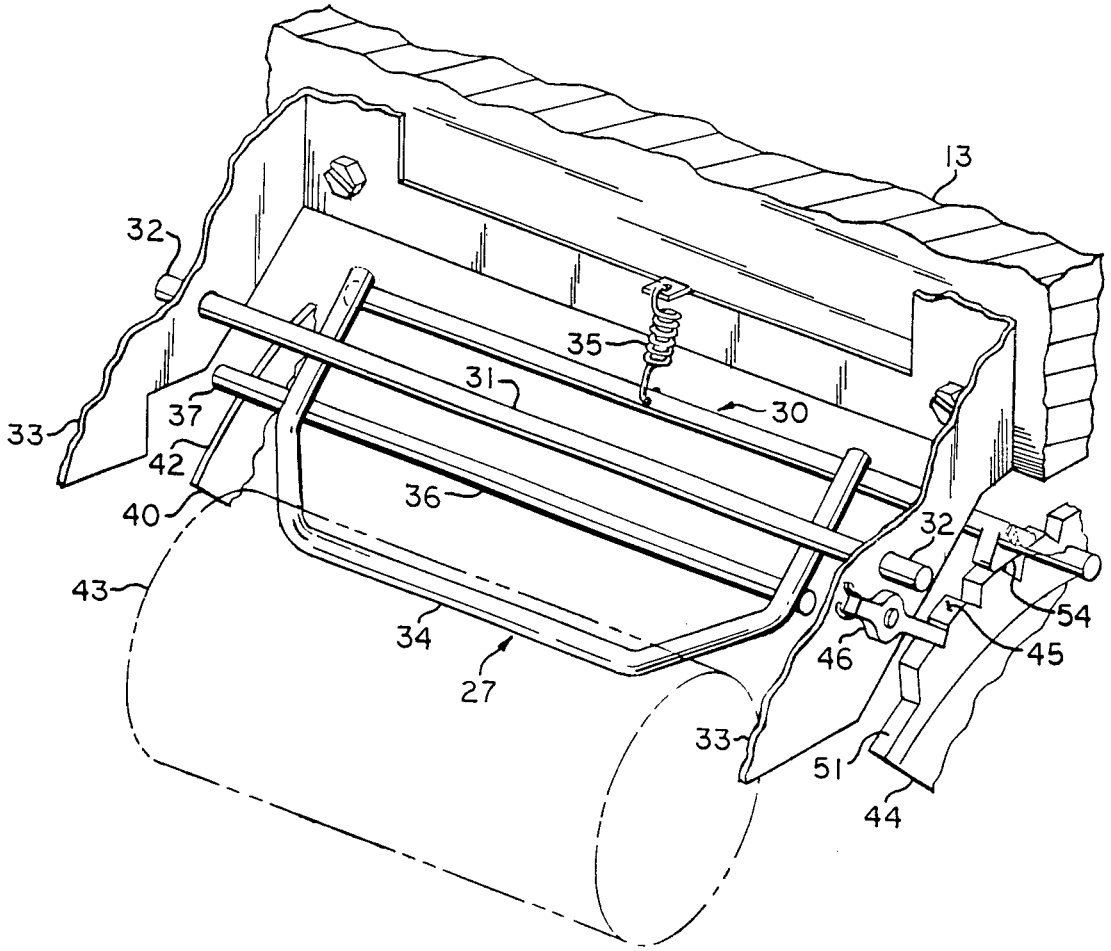
FIG. 16 is an enlarged perspective view illustrating the cradle and mounting thereof.

Mounted on the bracket 33 is a resilient catch 73 that is normally located outside of the movable path of projection 66 of the interlock arm 63, yet resiliently bears against the lateral projection 66. When the interlock arm 63 is moved to its second position as illustrated in FIG. 1 upon operation of the solenoid 70, the catch 73 will snap in front of and engage the lateral projection 66 as shown in FIG. 13, and will hold the interlock arm 63 in its second position upon de-energization of the solenoid 70.

Operatively interconnecting each door 14–16 and the one end 61 of the slide bar 55–57 associated with said door is a slide bar actuating means to preclude movement of any door from its first closed position when the interlock means is in its first position to block sliding movement of the slide bar 55 of the said one end door opening 10. The slide bar actuating means operatively engages the said one end of the slide bar associated with one selected door to move adjacent aligned slide bars located at one side of the selected door so that the slide bar 55 of the said one end door opening 10 is moved to the extended position, to allow movement of the said one selected door from its first closed position to its second open position, when the interlock means is in its second position as shown in FIG. 11.

More particularly, the slide bar actuating means includes actuating plates 74,75 and 76 attached and carried respectively by the cradles 30 of the associated doors 14–16 respectively. When the doors 14–16 are located in their first closed positions, the actuating plates 74–76 are located adjacent to and at one side of the said one ends of the slide bars having the cam surfaces 61 as shown in FIGS. 1 and 2. Each actuating plate 74–76 includes a cam surface 69, as shown in FIG. 8, that is adapted to engage and coact with the cam surface 61 of the associated slide bar 55–57 respectively when the door 14–16 associated with such actuating plate 74–76 is moved from its first closed position toward its second open position.

Figure 9:
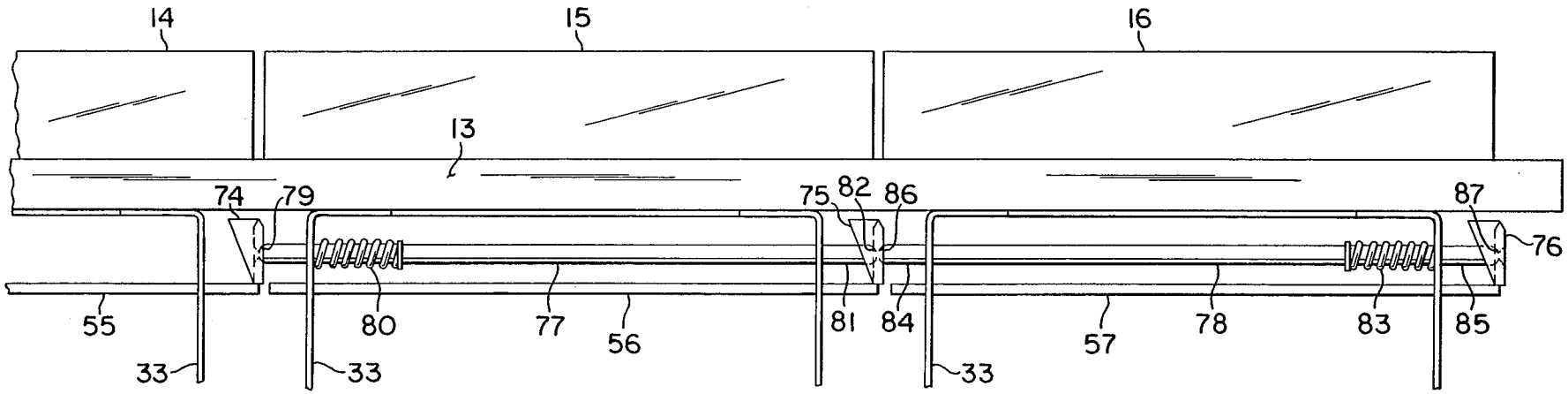
FIG. 9 is an enlarged, fragmentary view taken on line 9—9 of FIG. 1.

As is best shown in FIG. 9, a pair of latch pins 77 and 78 are slidably mounted in the opposed brackets 33 of the associated doors 15 and 16. Carried on latch pin 77 is a compression spring 80 attached at one end to the pin 77 and engaging the adjacent bracket 33, the spring 80 tending to hold the pin 77 in its initial position with its projected end 81 interfitting a compatible detent 82 formed in the adjacent actuating plate 75. A similar compression spring 83 is carried by the latch pin 78, having one end attached to the pin 78 and the other end engaging the associated bracket 33, the spring 83 tending to hold the latch pin 78 in its initial position with its projecting ends 84 and 85 operatively engaging associated detents 86 and 87 respectively formed in the actuating plates 75 and 76 respectively.

It is thought that the operation and functional advantages of this article-dispensing assembly have become fully apparent from the foregoing detailed description of parts, but for completeness of disclosure, the operation of each door will be described. It will be assumed that each door 14–16 is in its first closed position, and that the serpentine racks are filled with articles such as cans to be dispensed. In the closed positions of the doors 14–16, the associated cradle 30 for each of these doors 14–16 is located in its first position so that the transverse rod 34 is raised to a first position so as not to block the transfer of the article 43 seated on the rack ledge 26 into the associated door bin. Therefore, the article to be dispensed upon opening of any particular door is located in the door bin, and another article 43 is seated on the rack ledge 26 ready to be dispensed upon subsequent operation.

Upon depositing of sufficient coins in the vending machine, the solenoid 70 is actuated so that the solenoid armature 71 pivots the interlock arm 63 from its first position shown in FIG. 10 to its second position as shown in FIG. 11, in which the interlock arm 63 actuates the switch 72. Further, upon movement of the interlock arm 63 to its second position as shown in FIG. 11, the catch member 73 moves in overlapping relation to the lateral projection 66 and tends to hold the actuating arm 63 in its second position.

Then, the door 14 is pulled toward its second open position. During such door movement, the cam surface 69 of the actuating plate 74 engages the cam surface 61 on one end of the slide bar 55 to slide the bar 55 longitudinally to its extended position, in which the cam surface 67 of the slide bar 55 is moved in overlapping relation in front of the cam surface 65 of the interlock arm 63.

As described above, upon opening movement of any of the doors 14–16, the lateral projection 37 of the cradle 30 unseats from the peripheral ledge 41 and moves into the curvilinear peripheral recess 42, thereby allowing the cradle 30 to pivot under the loading of spring 35 to its second position so that the transverse rod 34 moves into blocking relation between the feed means and door bin, the rod 34 engaging the article 43 seated on the rack ledge 26 and preventing movement therefrom.

Further, the pawl 46 engages the ratchet teeth 45 and assures movement of the door 14 to its fully opened position before such door 14 can be closed.

It will be understood that when the door 14 is moved toward its opened position, the actuating plate 74 moves in front of the adjacent slide bar 56, and precludes sliding movement of the slide bars 56 and 57, and thereby precludes opening of the adjacent doors 15 and 16.

Also, it will be understood that when the slide bar 55 is moved to its extended position as described previously, the stud 90 carried by the latch bar 55 engages the catch member 73 and moves the catch member 73 out of blocking relation with the lateral projection 66.

The weight of the article 52 to be dispensed and held in the door bin overcomes the loading of the door spring 53, and holds the door 14 in its open position until the user removes the article 52 from the door bin. When the article 52 is removed, the spring 53 acts to move the door 14 from its open position to its closed position.

Again, it will be understood that as each door 14–16 is moved toward its closed position, the pawl 46 engages the ratchet teeth 45, and precludes reverse movement of the door towards its open position until such door is moved to its fully closed position. Further, the lateral projection 32 of the associated cradle 30 moves along the peripheral recess 42 and seats on its holding peripheral ledge 41 when the door is located in its fully closed position. Upon such occurance, the cradle 30 of the associated door is moved to its first position so that the transverse rod 34 is raised out of blocking engagement with the article 43 seated on the rack ledge 26, thereby allowing the article 43 to move into the door bin for subsequent dispensing by the door. Another article will then fall under gravity along the serpentine rack and on the rack ledge 26.

Figure 12:
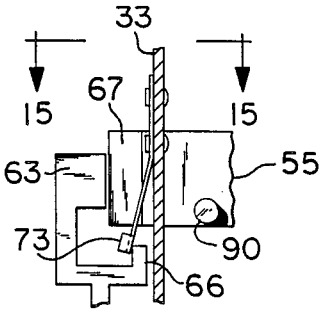
FIG. 12 is a fragmentary cross-sectional view taken on line 12—12 of FIG. 10.

When the door 14 is then located in its fully closed position, the actuating plate 74 is effectively disengaged from the camming surface 61 of the slide bar 55 thereby allowing the spring 67 to move the interlock arm 63 from its second position shown in FIG. 11 to its first position shown in FIG. 10. During such pivotal movement of the interlock arm 63, the cam surface 65 of the interlock arm 63 engages the cam surface 67 on the one end of the slide bar 55 to cam or slide the slide bar 55 from its extended position back to its initial position as shown in FIGS. 1 and 12.

To dispense the article held in the bin of door 15, the door 15 is moved from its closed position to its open position. During such initial opening movement, the latch pin 77 is operatively disengaged from the detents 79 and 82 of the adjacent actuating plates 74 and 75, and the cam surface 69 of the actuating plate 75 operatively engages the cam surface 61 of the slide bar 56, thereby sliding the slide bar 56 into operative engagement with the adjacent slide bar 55 to move the slide bar 55 into its extended position as described previously. When the door 15 is in its fully open position, and the article 52 is removed, the door 15 will move back to its closed position. When in the closed position, the cam surface 65 of the interlock arm 63 will effectively engage the cam surface 67 of the extended slide bar 55, and thereby move both slide bars 55 and 56 back to their initial positions.

It will be understood that when the door 15 is being moved toward its open position, the actuating plate 75 will move effectively in front of the end of the adjacent slide bar 57 to preclude opening of the adjacent door 16. Moreover, the actuating plate 74 associated with the other adjacent door 14 will engage the extended slide bar 56 to preclude opening movement of the door 14.

When the door 15 is located in its fully closed position, the latch pin 77 will be moved by its associated spring 80 back into the detents 79 and 82 of the actuating plates 74 and 75.

To dispense an article 52 held within the bin of the door 16, the door 16 is moved from its closed position to its open position. During the initial opening of the door 16, the latch pin 78 will effectively disengage under the loading of its spring 83 from the detent 87 of actuating plate 76. The cam surface 69 of the actuating plate 76 will effectively engage the cam surface 61 of the slide bar 57 thereby moving the slide bar 57 into effective engagement with the slide bar 56, and moving the slide bar 56 into effective engagement with the adjacent slide bar 55, whereby to move the slide bar 55 to its extended position as described previously.

It will be understood that when the door 16 is moved toward its open position, the actuating plate 74 will engage the extended slide bar 56 to preclude opening of the door 14, and the actuating plate 75 will effectively engage the extended slide bar 57 to preclude opening of the door 15.

When the door 16 is moved to its fully closed position, the cam surface 65 of the interlock arm 63 will effectively engage the cam surface 67 of the extended slide bar 55 and will move the interengaging slide bars 55–57 back to their original positions. Further, the latch pin 78 will move under the loading of its associated spring 83 back into effective engagement with the detents 86 and 87 of the actuating plates 75 and 76 respectively.

We claim as our invention:

1. An article-dispensing assembly, comprising:

(a) a plate provided with an opening, (b) a door movably mounted on the plate, the door being movable selectively to a first closed position and to a second open position relative to the opening, and the door including a shelf extending inwardly of the opening and providing a bin for holding an article to be dispensed, (c) feed means for feeding articles to the bin, (d) a control means movable to a first position to allow transfer of an article from the feed means to the bin, and movable to a second position to block transfer of an article from the feed means to the bin, (e) operating means selectively interconnecting the control means and door to allow loading of the bin when the door is in its first closed position and to preclude loading of the bin when the door is moved from its first closed position, (f) a slide bar slidably mounted and extending transversely of the bin, (g) an interlock means movably mounted at one side of the opening and movable to a first position blocking sliding movement of the slide bar, and to a second position allowing sliding movement of the slide bar to an extended position, (h) coin-actuating means connected to the interlock means and selectively moving the interlock means from its first position to its second position, and (i) a slide bar actuating means carried by the control means and operatively interconnecting the door and the slide bar and operatively engaging the slide bar to move the slide bar to the extended position to allow movement of the door from its first closed position to its second open position when the interlock means is in its second position.

2. An article-dispensing assembly as defined in claim 1, in which:

(j) the slide bar includes a cam surface, and (k) the interlock means includes a cam surface selectively engageable with said cam surface of the slide bar to move the slide bar from the extended position to its initial position when the door is moved from its second open position to its first closed position.

3. An article-dispensing assembly as defined in claim 1, in which:

(j) the operating means includes means on the door having a ledge and a recess leading to the ledge, and (k) the control means carrying the slide bar actuating means includes means selectively engageable with and seating on the ledge to hold the control means in the first position out of the path of the article to allow transfer from the feed means when the door is closed, said means unseating from the ledge and moving into the recess to urge the control means in the second position into the path of the article to preclude transfer from the feed means when the door is moved from the closed position.

4. An article-dispensing assembly as defined in claim 1, in which:

(j) the operating means includes a sidewall on the door having a peripheral margin, and (k) means on the control means selectively engages with the peripheral margin to preclude movement of the control means from the second position when the door is moved from the closed position.

5. An article-dispensing assembly as defined in claim 1, in which:

(j) latch means disengageably engage the slide bar actuating means carried by the control means tending to maintain the door in the first closed position.

6. An article-dispensing assembly as defined in claim 1, in which:

(j) the interlock means is selectively engageable with the slide bar to move the slide bar from the extended position to its initial position when the door is moved from its second open position to its first closed position and the interlock means moves to its first position.

7. An article-dispensing assembly as defined in claim 6, in which:

(k) the control means includes a cradle pivotally mounted on a pivot axis, the cradle carrying the slide bar actuating means and having article-engageable means extending transversely between the feed means and the door bin, (l) the operating means is operatively connected to the cradle, and tends to hold the transverse article-engageable means in the first position to allow transfer of the article from the feed means to the bin, and (m) resilient means is connected to the cradle and tends to urge the transverse article-engageable means toward the second position to preclude transfer of the article from the feed means.

8. An article-dispensing assembly as defined in claim 6, in which:

(k) the operating means interconnecting the control means, carrying the slide bar actuating means, and door preclude manual actuation of the control means to the first position when the door is moved from the closed position.

9. An article-dispensing assembly as defined in claim 6, in which:

(k) a catch means engages and holds the interlock means in the second position, and (l) the slide bar engages and releases the catch means when the slide bar is moved to its extended position with the slide bar in overlapping relation with the interlock means to allow the interlock means to return to its first position.

10. An article-dispensing assembly as defined in claim 9, in which:

(m) the interlock means includes a resilient means tending to urge the interlock means against the slide bar to retract the slide bar from its extended position to its initial position when the door is moved to its first closed position and the interlock means moves to its first position.

11. An article-dispensing assembly as defined in claim 1, in which:

(j) the plate includes a plurality of door openings, (k) a plurality of doors are mounted on the plate and are adapted to close and open the door openings, each door having a bin, (l) a plurality of feed means are provided for feeding articles to the door bins, (m) a control means is provided for each door, (n) an operating means selectively interconnects the control means for each door and the associated door, (o) a plurality of slide bars are provided in longitudinal alignment, one of the slide bars being slidably mounted and extending transversely of each door bin, (p) the interlock means is movably mounted at one end door opening, and is movable to a first position blocking sliding movement of the slide bar of the said one end door opening and to a second position allowing sliding movement of the last said slide bar to an extended position, and (q) a slide bar actuating means carried by an associated control means operatively interconnects each door and slide bar associated with said door to preclude movement of any door from its first position when the interlock means is in its first position to block sliding movement of the slide bar of the said one end door opening, and operatively engages said slide bar associated with one selected door to move adjacent aligned slide bars so that the slide bar of the said one end door opening is moved to the extended position to allow movement of the said one selected door from its first closed position to its second open position when the interlock means is in its second position.

12. An article-dispensing assembly as defined in claim 11, in which:

(r) the slide bar actuating means operatively connected to said one selected door blocks opposed adjacent aligned slide bars when the selected door is opened to preclude opening of any doors associated with the opposed slide bars.

13. An article-dispensing assembly as defined in claim 11, in which:

(r) the slide bars associated with the door adjacent one side of said selected door blocking the slide bar actuating means associating with each said adjacent door when the selected door is opened to preclude opening of any doors located at said one side.

14. An article-dispensing assembly as defined in claim 11, in which:

(r) the slide bar actuating means operatively connected to said one selected door blocks the adjacent aligned slide bars located at the other side of said selected door when the selected door is opened to preclude opening of any door located at said other side, and (s) the slide bars associated with the doors adjacent said one side of said selected door blocks the slide bar actuating means associated with each said adjacent door when the selected door is open to preclude opening of any doors located at said one side.

15. An article-dispensing assembly as defined in claim 11, in which:

(r) the interlock means is selectively engageable with the slide bar of the one end door opening to move the last said slide bar from the extended position and move the aligned interengaging slide bars back to initial positions when said selected door is moved from its second open position to its first closed position and the interlock means moves to its first position.

16. An article-dispensing assembly as defined in claim 15, in which:

(s) a catch means engages and holds the interlock means in the second position, and (t) the slide bar of the one end door engages and releases the catch means when moved to its extended position with the interlock means and the last said slide bar in overlapping relation with the interlock means to allow the interlock means to return to its first position.

17. An article-dispensing assembly as defined in claim 16, in which:

(u) the interlock means includes a resilient means tending to urge the interlock means against the said slide bar of the one end door opening to retract the last said slide bar from its extended position and move the aligned interengaging slide bars back to initial positions when the door is moved to its first closed position and the interlock means moves to its first position.

18. An article-dispensing assembly, comprising:

(a) a plate provided with an opening, (b) a door movably mounted on the plate, the door being movable selectively to a first closed position and to a second open position relative to the opening, and the door including a shelf extending inwardly of the opening and providing a bin for holding an article to be dispensed, (c) feed means for feeding articles to the bin, (d) a control means movable to a first position to allow transfer of an article from the feed means to the bin, and movable to a second position to block transfer of an article from the feed means to the bin, (e) operating means selectively interconnecting the control means and door to allow loading of the bin when the door is in its first closed position and to preclude loading of the bin when the door is moved from its first closed position, (f) a slide bar slidably mounted and extending transversely of the bin, (g) an interlock means movably mounted at one side of the opening and movable to a first position blocking sliding movement of the slide bar, and to a second position allowing sliding movement of the slide bar to an extended position, (h) coin-actuating means connected to the interlock means and selectively moving the interlock means from its first position to its second position, (i) a slide bar actuating means operatively interconnecting the door and the slide bar and operatively engaging the slide bar to move the slide bar to the extended position to allow movement of the door from its first closed position to its second open position when the interlock means is in its second position, (j) slide bar including a first cam surface, and (k) the slide bar actuating means being carried by the control means and engaging the first cam surface of the slide bar to move the slide bar to the extended position.

19. An article-dispensing assembly as defined in claim 18, in which:

(l) the slide bar includes a second cam surface, and (m) the interlock means includes a cam surface selectively engageable with the second cam surface of the slide bar to move the slide bar from the extended position to its initial position when the door is moved from its second open position to its first closed position.

20. An article-dispensing assembly, comprising:

(a) a plate provided with an opening, (b) a door movably mounted on the plate, the door being movable selectively to a first closed position and to a second open position relative to the opening, and the door including a shelf extending inwardly of the opening and providing a bin for holding an article to be dispensed, (c) feed means for feeding articles to the bin, (d) a control means movable to a first position to allow transfer of an article from the feed means to the bin, and movable to a second position to block transfer of an article from the feed means to the bin, (e) operating means selectively interconnecting the control means and door to allow loading of the bin when the door is in its first closed position and to preclude loading of the bin when the door is moved from its first closed position, (f) a slide bar slidably mounted and extending transversely of the bin, (g) an interlock means movably mounted at one side of the opening and movable to a first position blocking sliding movement of the slide bar, and to a second position allowing sliding movement of the slide bar to an extended position, (h) coin-actuating means connected to the interlock means and selectively moving the interlock means from its first position to its second position, (i) a slide bar actuating means operatively interconnecting the door and the slide bar and operatively engaging the slide bar to move the slide bar to the extended position to allow movement of the door from its first closed position to its second open position when the interlock means is in its second position, (j) the slide bar including a first cam surface and a second cam surface, (k) the slide bar actuating means being carried by the control means and engaging the first cam surface of the slide bar to move the slide bar to the extended position, and (l) the interlock means including a cam surface selectively engageable with the second cam surface of the slide bar to move the slide bar from the extended position to its initial position when the door is moved from the second open position to its first closed position.

21. An article-dispensing assembly as defined in claim 20, in which:

(m) a catch means engages and holds the interlock means in the second position, (n) the slide bar engages and releases the catch means when the slide bar is moved to its extended position with the cam surface of the interlock and the second cam surface of the slide bar in overlapping relation, and (o) the slide bar actuating means holding the slide bar in the extended position and holding the interlock means in its second position.

22. An article-dispensing assembly, comprising:

(a) a plate provided with an opening, (b) a door movably mounted on the plate, the door being movable selectively to a first closed position and to a second open position relative to the opening, and the door including a shelf extending inwardly of the opening and providing a bin for holding an article to be dispensed, (c) feed means for feeding articles to the bin, (d) a control means movable to a first position to allow transfer of an article from the feed means to the bin, and movable to a second position to block transfer of an article from the feed means to the bin, (e) operating means selectively interconnecting the control means and door to allow loading of the bin when the door is in its first closed position and to preclude loading of the bin when the door is moved from its first closed position, (f) a slide bar slidably mounted and extending transversely of the bin, (g) an interlock means movably mounted at one side of the opening and movable to a first position blocking sliding movement of the slide bar, and to a second position allowing sliding movement of the slide bar to an extended position, (h) coin-actuating means connected to the interlock means and selectively moving the interlock means from its first position to its second position, and (i) a slide bar actuating means operatively interconnecting the door and the slide bar and operatively engaging the slide bar to move the slide bar to the extended position to allow movement of the door from its first closed position to its second open position when the interlock means is in its second position, (j) the interlock means being selectively engageable with the slide bar to move the slide bar from the extended position to its initial position when the door is moved from its second open position to its first closed position, (k) the operating means including a sidewall on the door having a peripheral ledge and a peripheral recess leading to the ledge, and (l) the control means including a lateral projection selectively engageable with and seating on the peripheral ledge to hold the control means in the first position to allow transfer of the article from the feed means to the bin when the door is closed, the lateral projection unseating from the ledge and moving into the peripheral recess to move the control means in the second position to preclude transfer of the article from the feed means to the bin when the door is moved from the closed position.

23. An article-dispensing assembly as defined in claim 22, in which:

(m) resilient means is connected to the rod and tends to maintain the lateral projection seated on the ledge, and tends to urge the rod toward its second position when the projection is unseated from the ledge when the door is moved from the closed position.

24. An article-dispensing assembly, comprising:

(a) a plate provided with an opening, (b) a door movably mounted on the plate, the door being movable selectively to a first closed position and to a second open position relative to the opening, and the door including a shelf extending inwardly of the opening and providing a bin for holding an article to be dispensed, (c) feed means for feeding articles to the bin, (d) a control means movable to a first position to allow transfer of an article from the feed means to the bin, and movable to a second position to block transfer of an article from the feed means to the bin, (e) operating means selectively interconnecting the control means and door to allow loading of the bin when the door is in its first closed position and to preclude loading of the bin when the door is moved from its first closed position, (f) a slide bar slidably mounted and extending transversely of the bin, (g) an interlock means movably mounted at one side of the opening and movable to a first position blocking sliding movement of the slide bar, and to a second position allowing sliding movement of the slide bar to an extended position, (h) coin-actuating means connected to the interlock means and selectively moving the interlock means from its first position to its second position, (i) a slide bar actuating means operatively interconnecting the door and the slide bar and operatively engaging the slide bar to move the slide bar to the extended position to allow movement of the door from its first closed position to its second open position when the interlock means is in its second position, (j) the interlock means being selectively engageable with the slide bar to move the slide bar from the extended position to its initial position when the door is moved from its second open position to its first closed position, (k) the operating means interconnecting the control means and door precluding manual actuation of the control means to the first position when the door is moved from the closed position, (l) the operating means including a sidewall on the door having a peripheral margin, and (m) a pad on the control means selectively engaging with the peripheral margin to preclude movement of the control means from the second position when the door is moved from the closed position.

25. An article-dispensing assembly, comprising:

(a) a plate provided with an opening, (b) a door movably mounted on the plate, the door being movable selectively to a first closed position and to a second open position relative to the opening, and the door including a shelf extending inwardly of the opening and providing a bin for holding an article to be dispensed, (c) feed means for feeding articles to the bin, (d) a control means movable to a first position to allow transfer of an article from the feed means to the bin, and movable to a second position to block transfer of an article from the feed means to the bin, (e) operating means selectively interconnecting the control means and door to allow loading of the bin when the door is in its first closed position and to preclude loading of the bin when the door is moved from its first closed position, (f) a slide bar slidably mounted and extending transversely of the bin, (g) an interlock means movably mounted at one side of the opening and movable to a first position blocking sliding movement of the slide bar, and to a second position allowing sliding movement of the slide bar to an extended position, (h) coin-actuating means connected to the interlock means and selectively moving the interlock means from its first position to its second position, (i) a slide bar actuating means operatively interconnecting the door and the slide bar and operatively engaging the slide bar to move the slide bar to the extended position to allow movement of the door from its first closed position to its second open position when the interlock means is in its second position, (j) the interlock means being selectively engageable with the slide bar to move the slide bar from the extended position to its initial position when the door is moved from its second open position to its first closed position, (k) the operating means interconnecting the control means and the door including:

1. a sidewall on the door having a peripheral margin, the peripheral margin being provided with ratchet teeth, and
2. a pivotally mounted, double-acting pawl operatively engaging the teeth for assuring door movement to either a fully open or fully closed position before reversal to the other position, and (l) the control means including a pad selectively engageable with the ratchet teeth to preclude movement of the rod from the second position when the door is moved from the closed position.

26. An article-dispensing assembly, comprising:

(a) a plate provided with an opening, (b) a door movably mounted on the plate, the door being movable selectively to a first closed position and to a second open position relative to the opening, and the door including a shelf extending inwardly of the opening and providing a bin for holding an article to be dispensed, (c) feed means for feeding articles to the bin, (d) a control means movable to a first position to allow transfer of an article from the feed means to the bin, and movable to a second position to block transfer of an article from the feed means to the bin, (e) operating means selectively interconnecting the control means and door to allow loading of the bin when the door is in its first closed position and to preclude loading of the bin when the door is moved from its first closed position, (f) a slide bar slidably mounted and extending transversely of the bin, (g) an interlock means movably mounted at one side of the opening and movable to a first position blocking sliding movement of the slide bar, and to a second position allowing sliding movement of the slide bar to an extended position, (h) coin-actuating means connected to the interlock means and selectively moving the interlock means from its first position to its second position, (i) a slide bar actuating means operatively interconnecting the door and the slide bar and operatively engaging the slide bar to move the slide bar to the extended position to allow movement of the door from its first closed position to its second open position when the interlock means is in its second position, (j) the plate including a plurality of door openings, (k) a plurality of doors being mounted on the plate and being adapted to close and open the door openings, each door having a bin, (l) a plurality of feed means being provided for feeding articles to the door bins, (m) a control means being provided for each door, (n) an operating means selectively interconnecting the control means for each door and the associated door, (o) a plurality of slide bars being provided in longitudinal alignment, one of the slide bars being slidably mounted and extending transversely of each door bin, (p) the interlock means being movably mounted at one end door opening, and being movable to a first position blocking sliding movement of the slide bar of the said open end door opening and to a second position allowing sliding movement of the last said slide bar to an extended position, (q) a slide bar actuating means operatively interconnecting each door and slide bar associated with said door to preclude movement of any door from its first position when the interlock means is in its first position to block sliding movement of the slide bar of the said one end door opening, and operatively engaging said slide bar associated with one selected door to move adjacent aligned slide bars so that the slide bar of the said one end door opening is moved to the extended position to allow movement of the said one selected door from its first closed position to its second open position when the interlock means is in its second position, (r) each slide bar including a first cam surface on one end, and (s) the slide bar actuating means for each door being carried by the control means for said door and engaging the first cam surface of the slide bar associated with said door to move aligned slide bars so that the slide bar of the said one end door opening is moved to the extended position.

27. An article-dispensing assembly, comprising:

(a) a plate provided with an opening, (b) a door movably mounted on the plate, the door being movable selectively to a first closed position and to a second open position relative to the opening, and the door including a shelf extending inwardly of the opening and providing a bin for holding an article to be dispensed, (c) feed means for feeding articles to the bin, (d) a control means movable to a first position to allow transfer of an article from the feed means to the bin, and movable to a second position to block transfer of an article from the feed means to the bin, (e) operating means selectively interconnecting the control means and door to allow loading of the bin when the door is in its first closed position and to preclude loading of the bin when the door is moved from its first closed position, (f) a slide bar slidably mounted and extending transversely of the bin, (g) an interlock means movably mounted at one side of the opening and movable to a first position blocking sliding movement of the slide bar, and to a second position allowing sliding movement of the slide bar to an extended position, (h) coin-actuating means connected to the interlock means and selectively moving the interlock means from its first position to its second position, (i) a slide bar actuating means operatively interconnecting the door and the slide bar and operatively engaging the slide bar to move the slide bar to the extended position to allow movement of the door from its first closed position to its second open position when the interlock means is in its second position, (j) the plate including a plurality of door openings, (k) a plurality of doors being mounted on the plate and being adapted to close and open the door openings, each door having a bin, (l) a plurality of feed means being provided for feeding articles to the door bins, (m) a control means being provided for each door, (n) an operating means selectively interconnecting the control means for each door and the associated door, (o) a plurality of slide bars being provided in longitudinal alignment, one of the slide bars being slidably mounted and extending transversely of each door bin, (p) the interlock means being movably mounted at one end door opening, and being movable to a first position blocking sliding movement of the slide bar of the said open end door opening and to a second position allowing sliding movement of the last said slide bar to an extended position, (q) a slide bar actuating means operatively interconnecting each door and slide bar associated with said door to preclude movement of any door from its first position when the interlock means is in its first position to block sliding movement of the slide bar of the said one end door opening, and operatively engaging said slide bar associated with one selected door to move adjacent aligned slide bars so that the slide bar of the said one end door opening is moved to the extended position to allow movement of the said one selected door from its first closed position to its second open position when the interlock means is in its second position, (r) the interlock means being selectively engageable with the slide bar of the one end door opening to move the last said slide bar from the extended position and move the aligned interengaging slide bars back to initial positions when said selected door is moved from its second open position to its first closed position, (s) a catch means engaging and holding the interlock means in the second position, (t) the slide bar of the one end door opening engaging and releasing the catch when moved to its extended position with the interlock means and the last said slide bar in overlapping relation, (u) the interlock means including a resilient means tending to urge the interlock means against the said slide bar of the one end door opening to retract the last said slide bar from its extended position and move the aligned interengaging slide bars back to initial positions when the door is moved to its first closed position, (v) each slide bar including a first cam surface on one end, and a second cam surface on the other end, (w) the slide bar actuating means is carried by the control means and engages the first cam surface of the slide bar associated with said one selected door, and (x) the interlock means includes a cam surface selectively engageable with the second cam surface of the slide bar of the one end door opening to move the last said slide bar from the extended position and move the aligned interengaging slide bars back to initial positions when the door is moved from its second opened position to its first closed position.

* * * * *